US007188745B2

(12) United States Patent
Schermel

(10) Patent No.: US 7,188,745 B2
(45) Date of Patent: Mar. 13, 2007

(54) TILTABLE MODULAR RECYCLE CONTAINER SYSTEM

(76) Inventor: Ferdinand Schermel, RR # 10, Brampton, Ontario (CA) L6V 3N2

( * ) Notice: Subject to any disclaimer, the term of this patent is extended or adjusted under 35 U.S.C. 154(b) by 204 days.

(21) Appl. No.: 09/872,914

(22) Filed: Jun. 1, 2001

(65) Prior Publication Data

US 2002/0014488 A1 Feb. 7, 2002

(51) Int. Cl.
*A47G 19/00* (2006.01)

(52) U.S. Cl. ..... 220/23.4

(58) Field of Classification Search ..... 220/23.4, 220/909, 756

See application file for complete search history.

(56) References Cited

U.S. PATENT DOCUMENTS

| | | | | |
|---|---|---|---|---|
| 581,322 | A * | 4/1897 | Winters | |
| 3,269,580 | A * | 8/1966 | Tolbert, Jr. | 220/23.4 |
| 4,691,840 | A * | 9/1987 | Ferbrache | |
| 5,445,397 | A * | 8/1995 | Evans | 206/505 |
| 5,558,254 | A * | 9/1996 | Anderson et al. | 220/23.86 |
| 6,176,559 | B1 * | 1/2001 | Tiramani et al. | 312/108 |
| 6,347,847 | B1 * | 2/2002 | Tiramani et al. | 312/108 |

* cited by examiner

*Primary Examiner*—Stephen Castellano

(57) ABSTRACT a system for transporting refuse and recycling materials to the curb in a single trip by forming single rigid entities from adjoining liftable size containers and a tiltable hitching device using an existing style of refuse container handles.

11 Claims, 10 Drawing Sheets

TILTABLE MODULAR RECYCLE CONTAINER SYSTEM

CROSS REFERENCE TO RELATED APPLICATIONS

| | | |
|---|---|---|
| U.S. Pat. No. 5,683,030 | MOORE | APRIL 1995 |
| U.S. Pat. No. 5,445,397 | EVANS | MAY 1994 |
| U.S. Pat. No. 5,192,092 | DIBENEDETTO | MARCH 1991 |
| U.S. Pat. No. 4,834,253 | CRINE | APRIL 1988 |
| U.S. Pat. No. 4,821,903 | HAYES | APRIL 1988 |
| U.S. Pat. No. 4,691,840 | FERBRACHE | SEPTEMBER 1987 |

BACKGROUND

1. Field of Invention

This invention relates to tiltable wheeled containers used for refuse and recycling storage, hitching and movement.

2. Description of Prior Art

Recycling bins have been used to store and move materials for over 40 years. The methods used are different for commercial and residential. Recycling was introduced long after refuse collection had be in place and has been treated as an independent operation. At first recyclable materials were piled separately, then bundled, then placed in a container, then more sophisticated containers were developed having multiple or divided containment areas. The problem with multiple bin units was that the contents had to be emptied into different larger containers making this a difficult task that required lifting all the contents and blocking the contents that were not to be dumped into the larger container . Residential recycle bin designs have been constrained by cost and lifting weight. The higher demand for separation of different recyclables has resulted in the need for two or more bins. Simple bins have been made stackable to reduce space and carts have been made to move the bins to the curb.

Recycle bins are presently a simple rectangular box with an edge for lifting and drain holes in the bottom since there is no cover from rain or snow. The size is determined by the lifting weight for the worst case scenario of wet newspaper. This bin requires bending to lift and must be held away from legs due to filth on the bin or rainwater that drips out of tilted cans and jars. This is very difficult especially for seniors or people with back problems. Recycle bins with wheels have not been commercially successful due to the maximum lifting weight does not allow the height of the container to reach an ergonomically suitable height to wheel the container. If the maximum size container was stretched to that height of about 34 inches free standing, then the base would be too small to be stable. The conventional 32 gallon wheeled refuse containers are already disliked by the collection workers for their instability and their narrow wheel base of the cylindrical shaped containers makes them difficult to roll. This has lead to square based containers to increase the wheel base and to prevent rolling in the wind when empty, even though the cylindrical shape provides greater structural integrity and simplicity of manufacture. The larger 60 gallon containers will not be emptied by the collection workers due to their excessive weight. Refuse and recycle containers that have dividers vertically such as in U.S. Pat. No. 4,834,253 to Crine are to difficult to dump because the entire weight must be lifted while only one portion is dumped and the remainder portions blocked.

The recycling cart of U.S. Pat. No. 5,192,092 to DIBENEDETTO (1991) is an expensive item by itself that would have to be unloaded and taken away from the curb or risk theft. The cart would then be brought back to the curb to pick up the empty bins. The cart still requires bins of which the owner may already have. The owner's bins may not fit the cart since recycle bins vary in dimension thus making universal cart manufacture difficult. The bins must also be secured and unsecured to the cart for rolling. The cart and bin of U.S. Pat. No. 4,821,903 to Hayes (1988) has the same problems of expense and theft but bins do not require securing. The bins are however custom made and are expensive to make and unsuitable for newspaper that would require "sliding in" instead of being "tossed on a pile".

The stackable refuse system of U.S. Pat. No. 5,445,397 to EVANS (1994) offers a more economically viable solution for a multiple bin unit. It also has the advantage of nesting which allows for efficient distribution. It also has the advantage of forming a rigid entity from several bins by means of a flexible strap with a clasp, thus providing the required ergonomic height for tilt and rolling and reducing the effective lifting weight upon detachment. However the method of securing to form a rigid entity is not a system that secures individual bins to each other (adjoining bins) but rather a strap that compresses a number of bins and wheel assembly to form a single rigid entity that can be tilted. The wheels must be added by a separate wheel assembly because there is no individual means of securing wheels to of bottom bin or added by the alternate embodiment, of a cart, to overcome this problem. The wheels are not integral with the bottom bin resulting in additional user labor. The preferred embodiment has lids because if stacked without them it would result in the unit sloping over the wheels. The alternative embodiment uses an expensive metal tubing cart which would require the lids as well to avoid the sloping problem but then allows for the elimination of the flexible strap and having to bend over to pick it up. This design cannot be blow moulded. The wheel base of the preferred embodiment will not nest within itself thus adding to the distribution cost, and the metal frame cart is even more cumbersome to ship. The lids add expense and require the additional labor of securing or removal upon dumping and then reassembly.

Wheeled objects that are tilted for rolling have never been secured together from their free standing position to form a single entity wheeled cart whether hitched or castor wheeled. Two wheel tilt and roll containers or any similar tilt and roll device, such as a luggage container, has never been hitched at the top end nor has there been a way to tilt the devices after being hitched. Trains of containers have be made for commercial application using hitched or linked dollies. These systems have the following disadvantages: requires independent dolly, the dolly has 4 wheels for stability, some or all of the wheels must have the ability to swivel to allow the train to go around corners, the castor wheels are small to keep reduce cost as well as reduce over all height to minimize vertical instability. The small wheels and instability limited the terrain to smooth indoor surfaces due to the inability for small wheels and swivel castors to roll over large bumps. The operator must be in a bent over position including the work and hardware to connect the containers to dollies. This work must the be undone and redone if there are any steps or stairs because the container dolly units cannot move independently in the vertical direction and the upper lateral movement is aggravated due to the height of the container since they are free to move independently at the top. Unless all 4 of the castors on the dollies are swivel type, the direction of train movement cannot be reversed and containers must be locked to the dollies thus limiting versatility.

SUMMARY

In accordance with the present invention a tiltable modular recycle container system comprising a new use for handles to form a rigid entity from independent adjoining containers, and a means to bring combinations of refuse and recycle containers to the curb in a single trip by hitching them at the top for transport in a tited position.

Objects and Advantages

Accordingly, besides the objects and advantages of the tiltable modular recycle container system described in my above patent, several objects and advantages of the present invention are:

(a) to provide a means to bring the refuse containers with the recycle bins to, as well as from the curb in a single trip.

(b) to provide a low cost multiple bin container that has a large overall weight capacity but can be tilted and rolled to the curb and then easily detached to reduce the effective lifting weight and direct sorted contents to separate destinations.

(c) to provide a recycle container that is secured to, or rests on, future or presently existing wheeled refuse containers in order to eliminate one of two trips as well as having to carry the recycle container in situations where only one recycle container is required.

(d) provide improved resting and rolling stability due to the larger bottom and wider wheel base by overcoming the codependent lifting weight/ergonomic rolling height constraint that determines the bottom size and wheel base width by means of dividing the container to reduce the effective lifting weight.

(e) to provide a new use for handles, which are presently used to lock the lid on refuse containers, for use in securing recycle bins on new and existing refuse containers, securing independent refuse and/or recycle bins into a rigid entity that can be tilted and rolled, and as well as part of a hitch that allows the containers to be tilted from the rest position while remaining hitched.

(f) to eliminate the need and expense of an independent cart for holding and moving recycle bins by securing independent recycle containers together to form a single rigid container that fulfills the function of the cart which can be tilted and rolled.

(g) wheeled objects that are tilted for rolling, secured together from their free standing position, to form a single entity wheeled cart using hitch or castor wheels for turning means, eliminates wheels and allows one to increase the capacity but still reduce effective lifting weight by unsecuring.

(h) to reduce the number of parts such as lids, flexible straps with clasps, independent dollies with small wheels and casters, carts and the means for securing all of the mentioned parts.

(i) to reduce and simplify operations and the number of operations for securing and unsecuring parts such as lids, flexible straps with clasps, independent dollies with small wheels and casters, and carts.

(j) to provide a system that can be added to existing refuse containers and modified to meet changing weekly needs such as alternating type of recycle pick up, and long term changing capacity needs.

(k) the wheeled containers will nest in each other and the recycle containers will nest in each other and the wheeled containers will also nest in the recycle containers and the lower size of recycle containers can partially nest in the upper size of recycle container, thus being able to form a single pile of any number of sizes of recycle containers with the wheeled containers reducing shipping costs and distributor shelf space even for small quantities.

(l) provide the ability to deposit recyclable materials without having to remove lid, lift door, or dismantle while still providing covering from rain and snow.

(m) provide low cost, easy to engage handles, that have a positive lock and are not subject to orientation of container placed on top of them, and have an ergonomic advantage of for lifting as well as all the advantages listed in the U.S. Pat. No. 4,691,840 FERBRACHE patent.

(n) provide a container system that could also function as a yard cart, general use cart, or luggage.

(o) to provide a design of recycle bin that can be blow moulded. Still further objects and advantages will become apparent from a consideration of the ensuing description and drawings.

DRAWING FIGURES

FIG. 1 shows an existing 32 gallon Rubbermaid refuse container with a recycle container secured on top of it and a three bin recycle container hitched to it.

FIG. 2 shows the cross section of the preferred embodiment of the interface of the wheeled recycle bin and the upper recycle bin, secured by the Ferbrache style of handles FIG. 2A shows the cross section of the preferred embodiment of the interface of the upper recycle bin and the upper recycle bin lid, secured by the Ferbrache style of handles FIG. 3 shows the cross section of an existing 32 gallon Rubbermaid refuse container with the preferred embodiment a refuse container recycle bin on top of it to be used when a single recycle bin is to be transported to the road without carrying it.

DESCRIPTION

Figure 1:
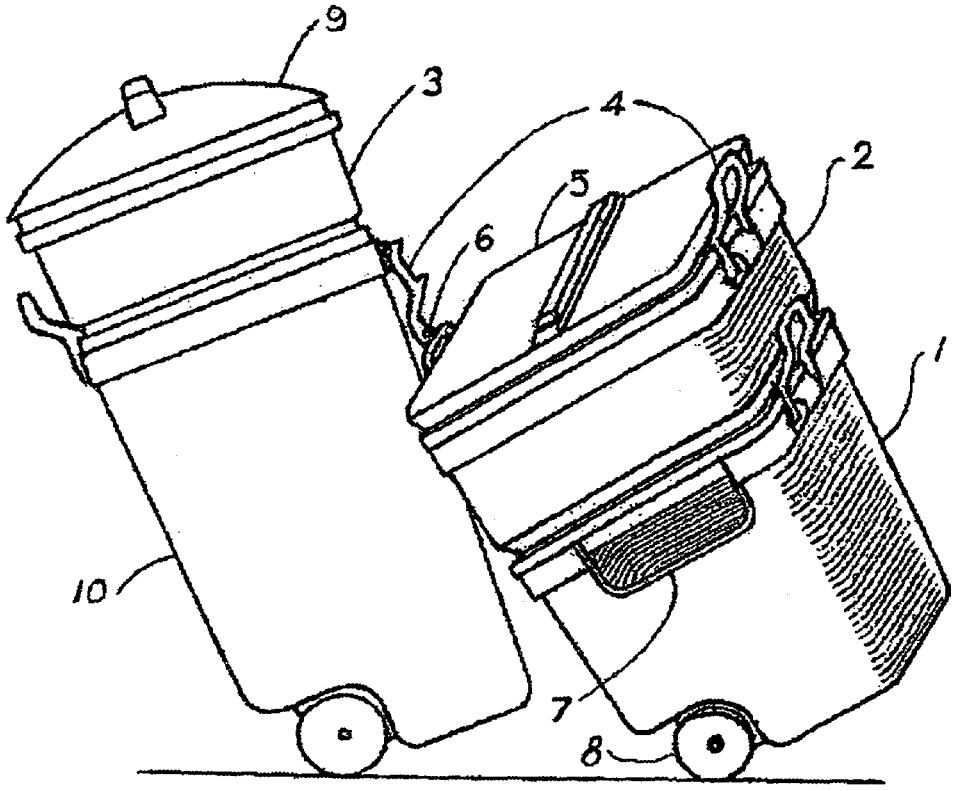

FIG. 1—Preferred Embodiment

A preferred embodiment of the present invention of the tiltable modular recycle container system is illustrated hitched to an existing 32 gallon Rubbermaid refuse container with a single recycle bin secured on top of it. This system allows for a single trip to the curb regardless of how many recycle bins or refuse containers are required without any carrying. The wheeled recycle bin 1 is preferably blow moulded or may be injection moulded, from the appropriate plastic for the type of manufacturing process used. The wheels 8 are located on the pulling side providing stability in the vertical rest position and a means for rolling near the center of gravity while tilted or moving. Refuse container lid 9 rests on the refuse container recycle bin 3. The flanged openings 7 has the flange protruding outward and allows items to be placed in without having to lift the upper and or middle recycle bin 2B or 2A. For indoor storage the recycle bins would have no opening in order to control odors. The handles 4 are used to secure the wheeled recycle bin 1 to the middle recycle bin 2A, middle recycle bin 2A to the upper recycle bin 2B, upper recycle bin 2B to the upper recycle bin lid 5, and the refuse container 10 to the refuse container recycle bin 3. The handle 4 of the refuse container recycle bin 3 is in the unsecured position and is hitched to the handle of the upper recycle bin 2B by the hitch 6.

FIG. 2

Figure 2:
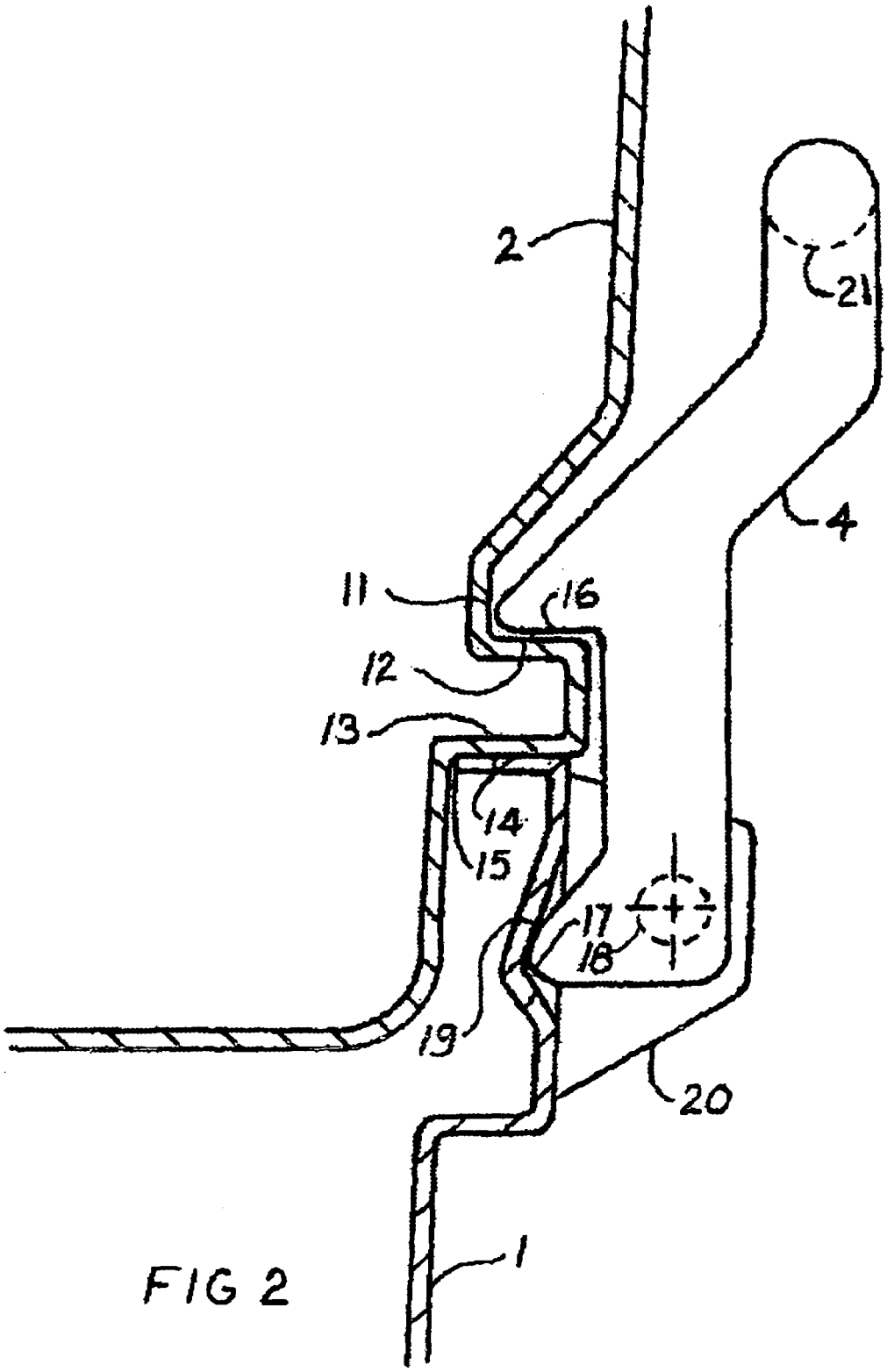

FIG. 2 shows the cross section of the preferred embodiment of the interface of the wheeled recycle bin 1 and the middle recycle bin 2A secured by the handle 4. Details of the handle can be found in U.S. Pat. No. 4,691,840 FERBRACHE patent. The middle recycle bin 2A resting position is determined horizontally by alignment edge 15 and vertically by support face 14. The tooth projections 16 prevent the middle recycle bin 2A from separating from the wheeled recycle bin by extending into indent 11 and restricting the movement, in the vertical direction, of base of indent 12. The grip 21 of the handle 4 allows lifting and releasing by rotating about stud projection 18 which pivots in mounting boss 20 to overcome resistance fit between lobe projections 17 and receptacle base recesses 19.

FIG. 2A

Figure 2A:
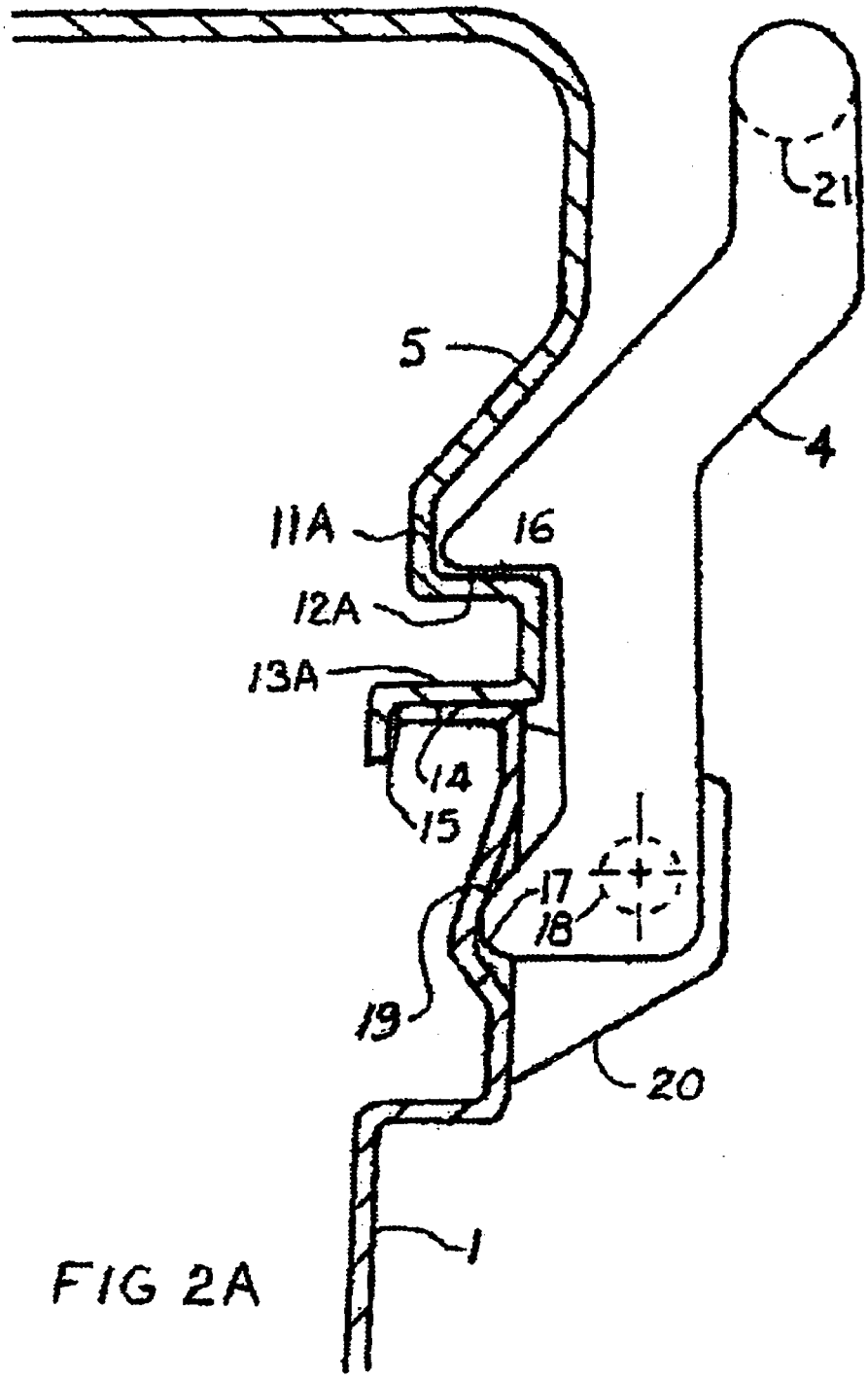

FIG. 2A shows the cross section of the preferred embodiment of the interface of the upper recycle bin 2A and the upper recycle bin lid 5 secured by the handle 4. Details of the handle can be found in U.S. Pat. No. 4,691,840 FERBRACHE patent. The upper recycle bin 2A resting position is determined horizontally by alignment edge 15 and vertically by support face 14. The tooth projections 16 prevent the upper recycle bin lid 5 from separating from the wheeled recycle bin by extending into lid indent 11A and restricting the movement, in the vertical direction, of lid base of indent 12A. The grip 21 of the handle 4 allows lifting and releasing by rotating about stud projection 18 which pivots in mounting boss 20 to overcome resistance fit between lobe projections 17 and receptacle base recesses 19.

FIG. 3

Figure 3:
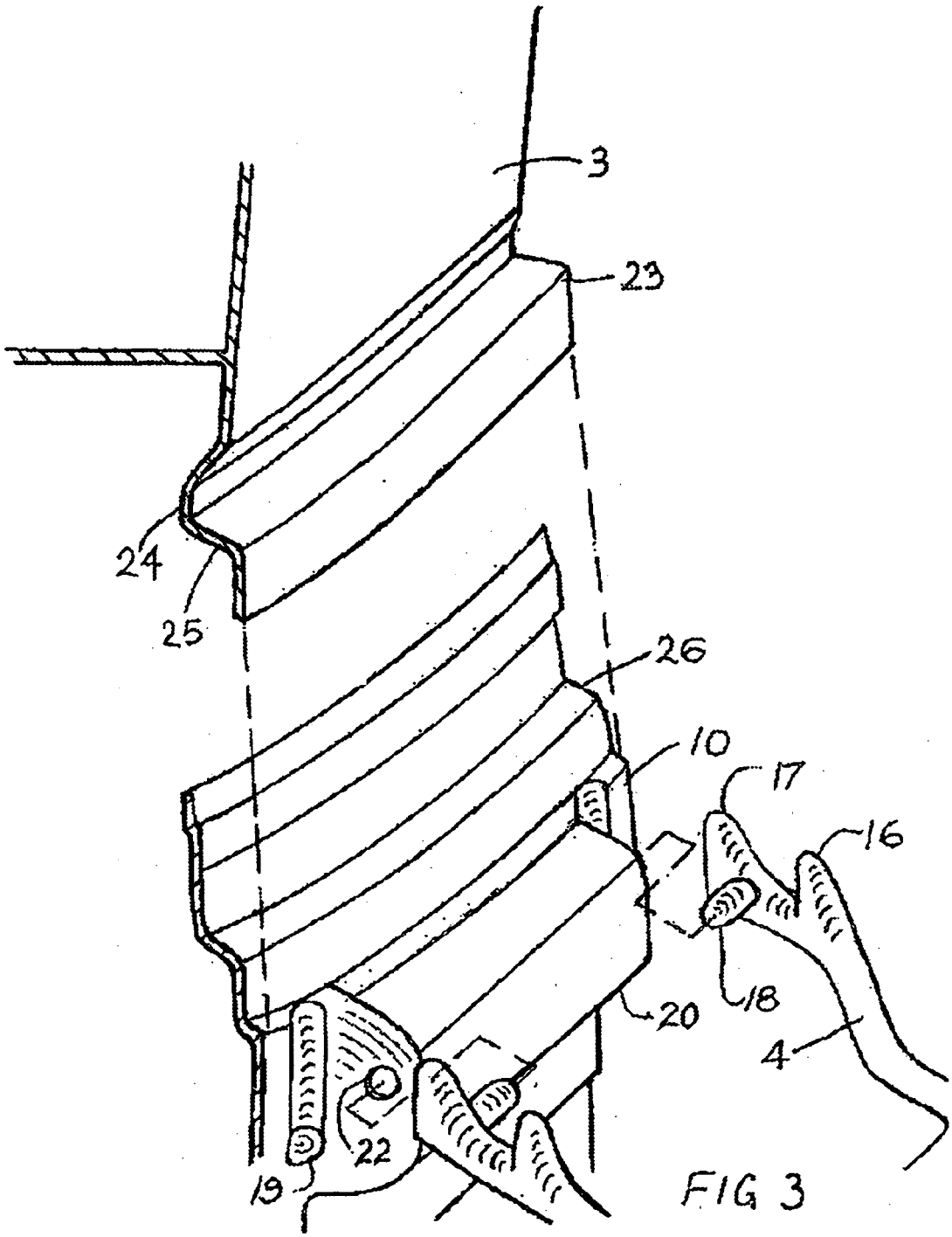

FIG. 3 shows the cross section of an existing 32 gallon Rubbermaid refuse container 10 with the preferred embodiment a refuse container recycle bin 3 on top of it to be used when a single recycle bin is to be transported to the road without carrying it. The refuse container recycle bin 3 is secured by the handle 4. Details of the handle can be found in U.S. Pat. No. 4,691,840 FERBRACHE patent. The refuse container recycle bin 3 resting position is determined horizontally by indent flange 24 and vertically by indent resting face 25 and resting shoulder 26. The tooth projections 16 prevent the refuse container recycle bin 3 from separating from the refuse container 10 by extending into indent flange 24 and restricting movement in the vertical direction of indent locking face 23 The grip 21 of the handle 4 allows lifting and releasing by rotating about stud projection 18 which pivots in mounting bass 20 to overcome resistance fit between lobe projections 17 and receptacle base recesses 19.

FIG. 4

Figure 4:
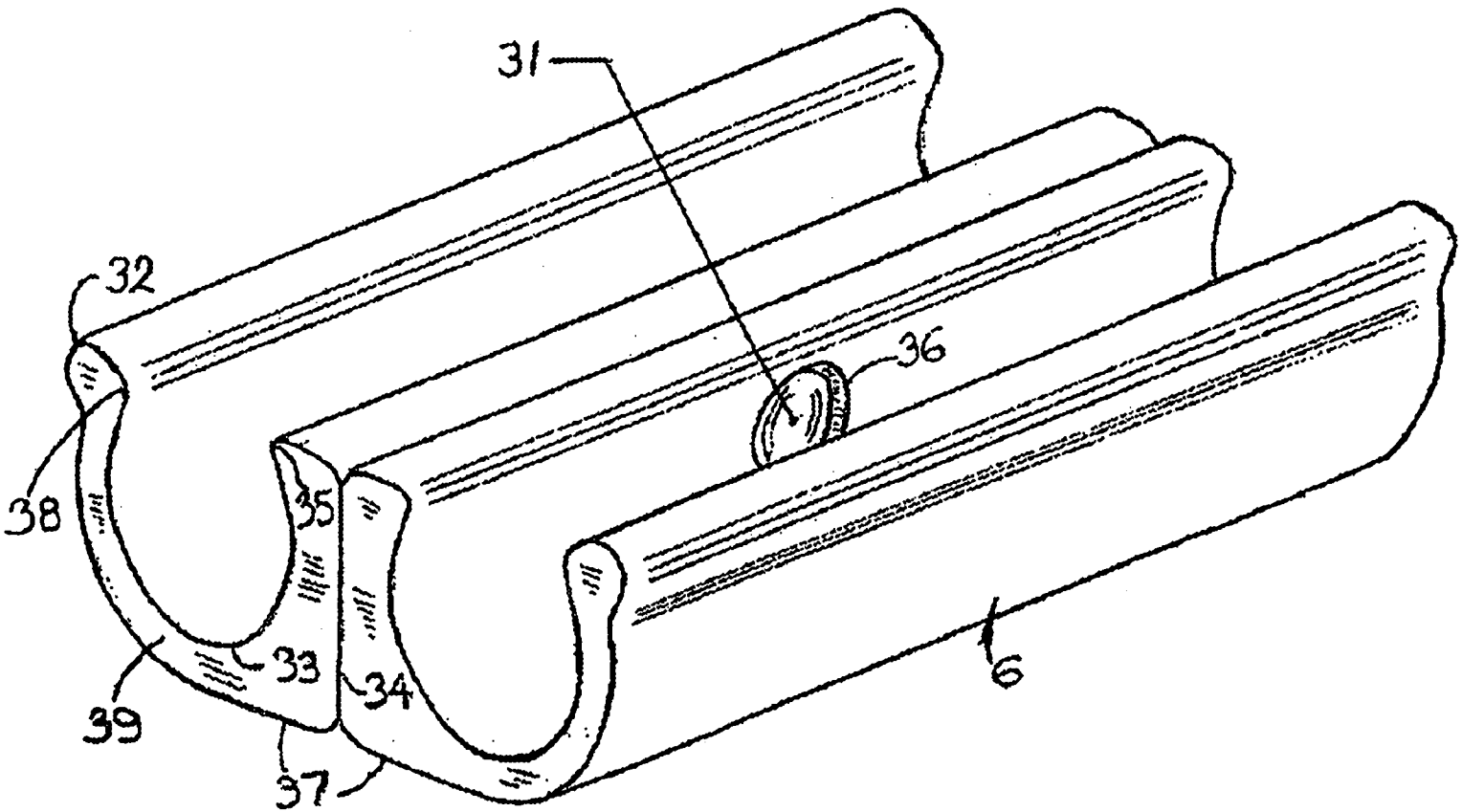
FIG. 4 shows the preferred embodiment of the hitch that would be used when connecting Ferbrache style of handles to existing refuse containers or recycle bin combinations.

FIG. 4 shows the preferred embodiment of the hitch 6 that would be used when connecting handles 4 of existing refuse containers 10 to each other or to upper recycle bin 2 that are secured to wheeled recycle bin 1 or any combination there of. The hatch 6 consists of two identical clasps 37 that can rotate relative to each other about rivet with washer 31 in the plane of the pivot face 34. The rivet with washer 31 hold the clasps 37 together through the countersink holes 36 which allow grip 21 of handle 4 to rotate freely in the clasp groove 33. The grip 21 is secured in the clasp groove 33 between the inner clasp projection 35 and the outer clasp projection 38 by the sprung action of flexible groove body 39. The release grip 32 allows pressure to be applied for unhitching of each clasp 37.

Figure 5:
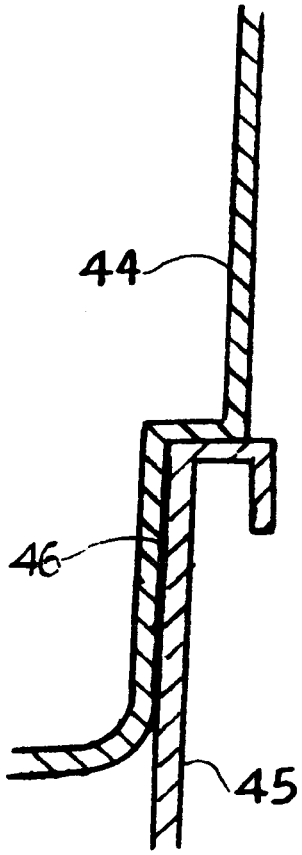
FIG. 5 shows an alternative embodiment of a telescope fit using a sufficiently long interface between the upper container and the lower container.

FIG. 5 Alternative Embodiment

FIG. 5 shows an alternative embodiment using a telescope fit by providing a sufficiently long interface at the slide lock interface 46 between the upper container 44 and the lower container 45 to create a rigid entity for tilting.

Figure 6:
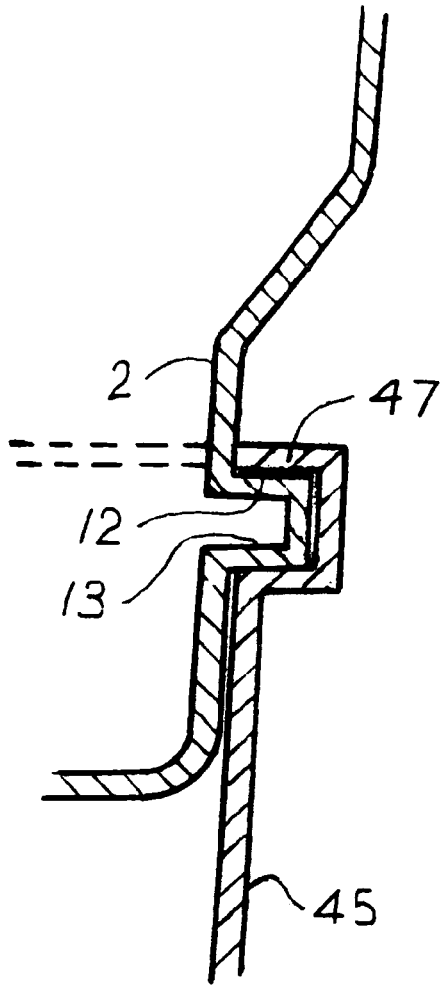
FIG. 6 shows an alternative embodiment of a recycle bin that slides in a lower container using a groove

FIG. 6 Alternative Embodiment

FIG. 6 shows an alternative embodiment of an upper recycle bin 2 which as secured, an the vertical direction, to the lower container 45 by insertion of base of indent 12 and rest face 13 into groove 47. The groove is parallel to the axis of the wheels 8 and perpendicular to the axis of the wheels on the non-insertion side of the groove where it connects the two parallel adjoining sides.

Figure 7:
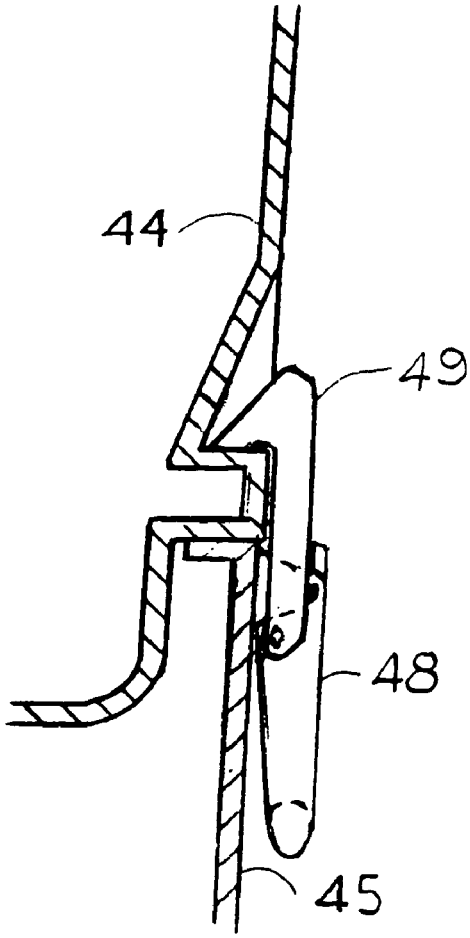
FIG. 7 shows an alternative embodiment of securing the containers together using over center type of locking handles

FIG. 7 Alternative Embodiment

FIG. 7 shows an alternative embodiment of securing, in the vertical direction, the lower container 45 to the upper container 44 by holding tooth 49 which is secured vertically and horizontally by the components of the over center holding device 48.

Figure 8:
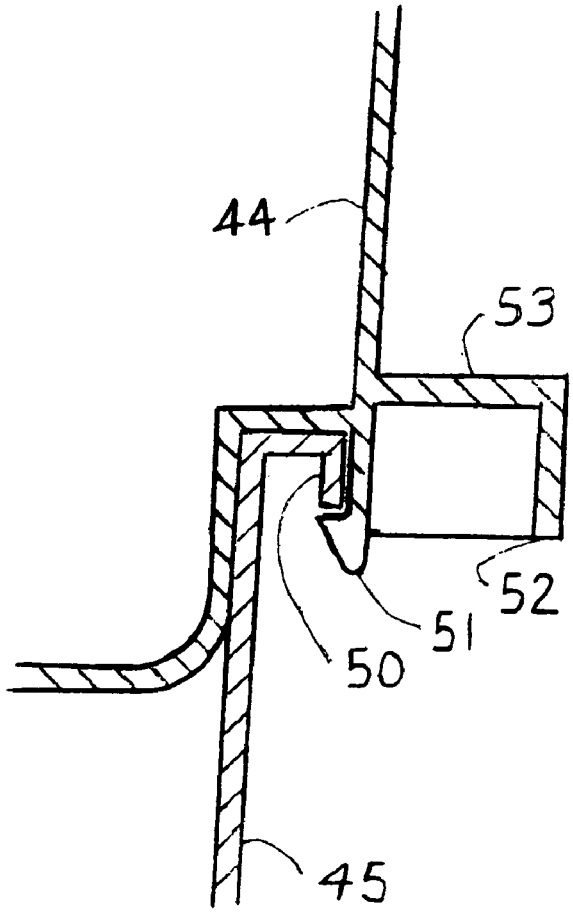
FIG. 8 shows an alternative embodiment of securing the containers together using handles with a moulded latch to form a rigid entity.

FIG. 8 Alternative Embodiment

FIG. 8 shows an alternative embodiment of securing the lower container 45 to the upper container 44 in the vertical direction by moulded latch 51 and locking edge 50. The release handle 53 is used to unsecure by applying an upward force on the gripping edge 52.

FIG. 9

Figure 9:
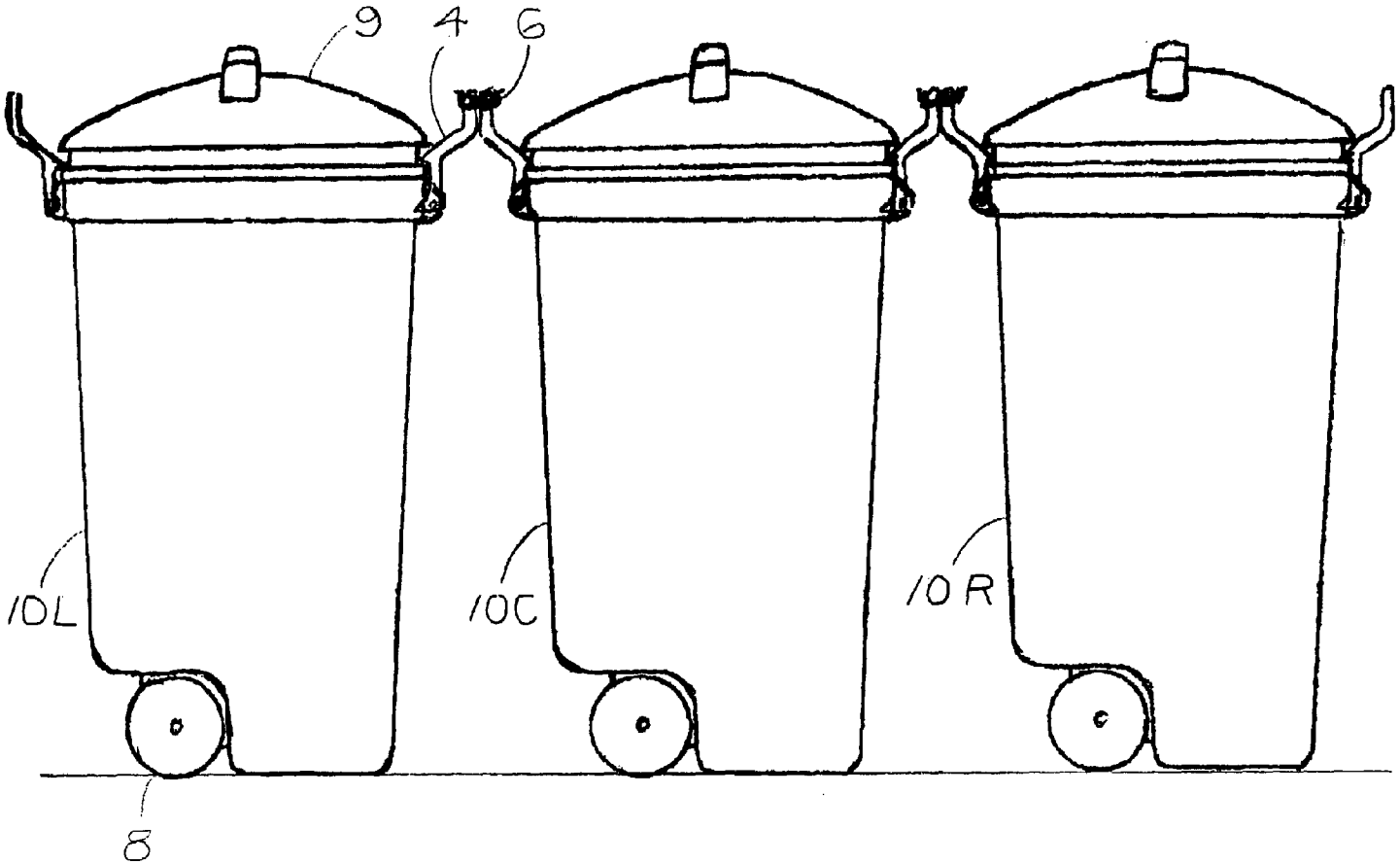
FIG. 9 shows three existing 32 gallon Rubbermaid refuse containers hitched together in the rest position

FIG. 9 shows three refuse containers 10 hitched together in the rest position. Lead container 10L has the handle 4 which is adjacent to the wheels, secured to one of the clasps 37 of the hitch 6. The other clasp 37 is secured to the handle 4 of the center container 10C which is located over the wheels 8. Center container 10L has the handle 4 which is adjacent to the wheels 8 secured to one of the clasps 37 of the hitch 6. The other clasp 33 is secured to the handle 4 of the center container 10R which as located over the wheels 8.

FIG. 10

Figure 10:
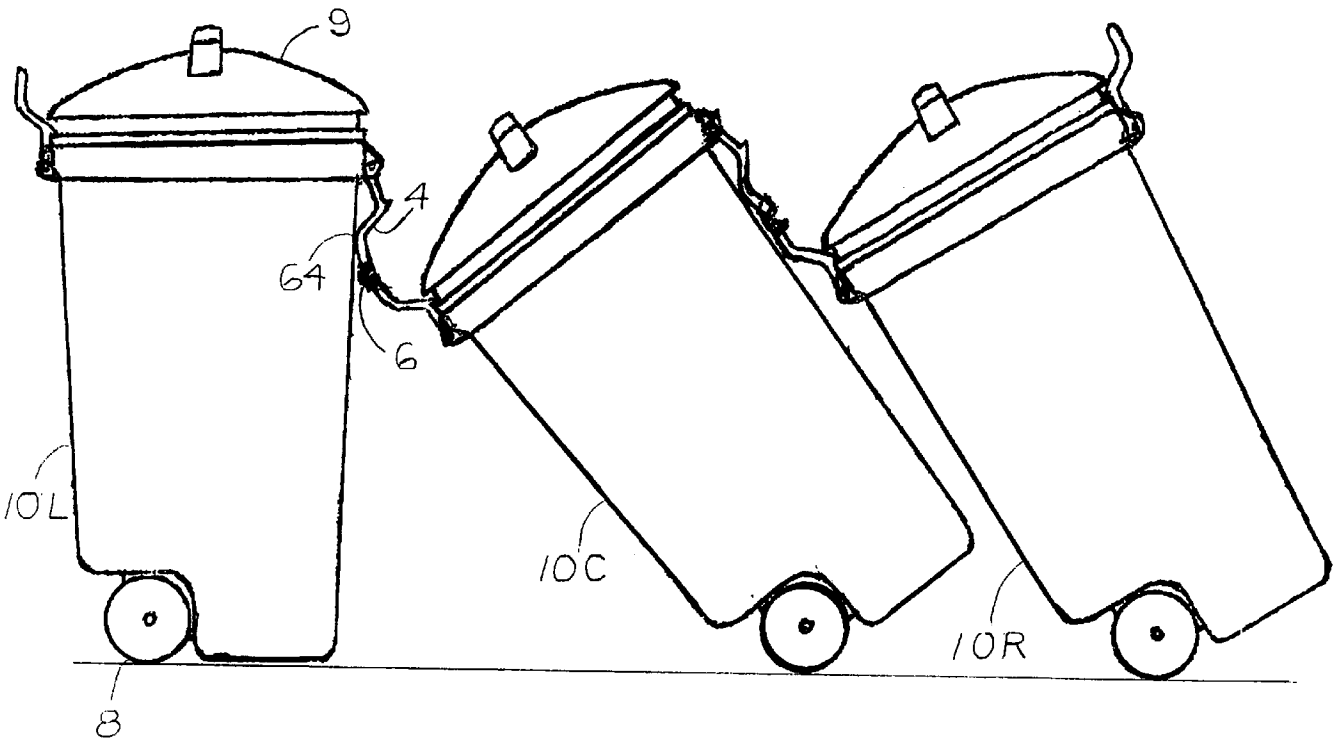
FIG. 10 shows three existing 32 gallon Rubbermaid refuse containers hitched together with the lead container in the rest position.

FIG. 10 shows the three refuse containers 10 of FIG. 9 with the lead container 10L in the rest position with the center container 10C and rear container 10R in the tilted position. Handle 4 of lead container 10L which is adjacent to the wheels 8 is supported by its own side at the handle tilted rest point 64 of the Center container 10C.

FIG. 11

Figure 11:
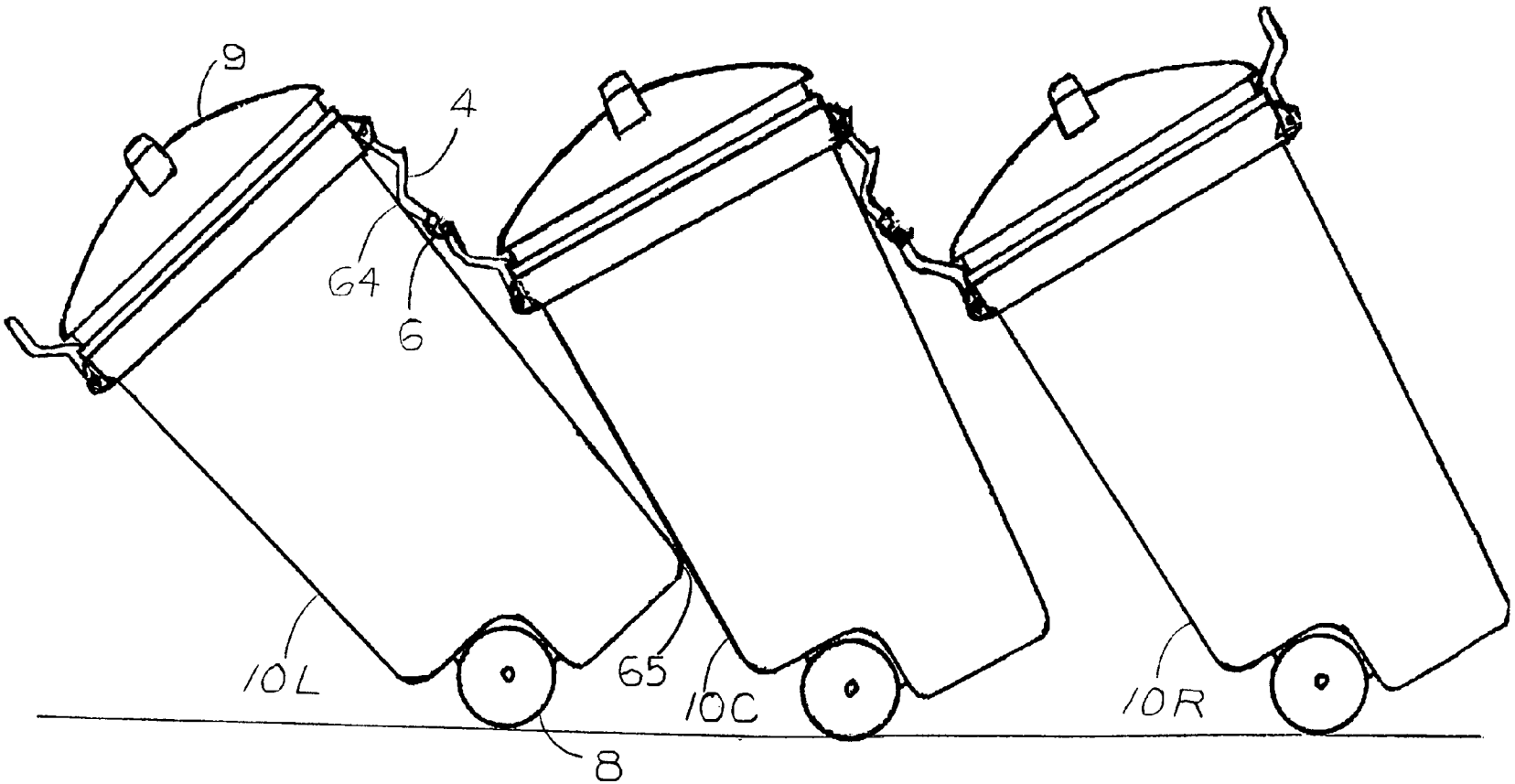
FIG. 11 shows three existing 32 gallon Rubbermaid refuse containers hitched together in the tilted free standing position.

FIG. 11 shows the three refuse containers 10 of FIG. 9 with the lead container 10L in the tilted free standing position also with the center container 10C and rear container 10R in the tilted position. Handle 4 of lead container 10L which is adjacent to the wheels 8 is supported by its own side at the handle tilted rest point 64 of the center container 10C and the lower corner of the lead container 10L which is adjacent to the wheels 8 is supported by the container tilted free standing point 65.

REFERENCE NUMERALS IN DRAWINGS

1 wheeled recycle bin
2A middle recycle bin
2B upper recycle bin
3 refuse container recycle bin
4 handles (existing prior art Ferbrache U.S. Pat. No. 4,691,840)
5 upper recycle bin lid
6 hitch
7 flanged opening
8 wheels
9 refuse container lid (for Rubbermaid 32 gallon refuse container existing prior art)
10 refuse container (Rubbermaid 32 gallon refuse container existing prior art)
10L lead container (Rubbermaid 32 gal refuse container existing prior art)
10C center container (Rubbermaid 32 gal refuse container existing prior art)
10R rear container (Rubbermaid 32 gal refuse container existing prior art)
11 indent
11A lid indent
12 base of indent
12A lid base of indent
13 rest face
13A lid rest face
14 support face
15 alignment edge
16 tooth projection
17 lobe projection
18 stud projection
19 receptacle base recesses
20 mounting boss
21 grip (portion of Ferbrache style handle also used for hitch)
22 assembly apertures
23 indent locking face
24 indent flange
25 indent resting face
26 resting shoulder
31 rivet with washer
32 release grip
33 clasp groove
34 pivot place
35 inner clasp projection
36 countersink hole
37 clasp
38 outer clasp projection
39 flexible groove body
44 upper container
45 lower container
46 slide lock interface
47 groove
48 over center holding device
49 holding tooth
50 locking edge
51 moulded latch
52 gripping edge
53 release handle
64 handle tilted rest point
65 container tilted free standing point Advantages From the description above, a number of advantages of my tilted modular recycle container system become evident:

a) securing individual containers directly to each other to form a single rigid entity, rather than a strap that compresses a number of bins and wheel assembly together, is much simpler to use.
b) a low cost simple, versatile system for home and commercial use
c) easily adapted to owner's existing refuse container and future changing needs
d) hitch is easily secured to the handles
e) hitch(s) can remain secured during; the trip from the curb, park and loading, and back to the curb, without having to be unsecured
f) the refuse container recycle bin allows for situations when only one recycle bin is required or alternating collection is practiced
g) the rivet with washer 31 of the hitch allows for turns greater than 90 degrees
h) the design of the clasp 37 transfers the load through the hitch while minimizing the force required for securing and unsecuring handles.
i) the multiple hitched containers can be tilted one at a time and left free standing tilted while be filled and parked
j) recycle bins can be blow moulded allowing for superior performance, lower cost plastics with lower tooling cost, and will also nest in each other.
k) the new use for a proven reliable, and practical handle wins the confidence of the consumer.
l) the improved stability due to the wider wheel base that can be obtained by forming a single rigid entity from smaller units.
m) light weight contents are secured from blowing away and kept dry by coverings.

Operation FIG. 1–11

The manner of operation of a handle 4 for securing containers on top of each other, specifically attached container on top of wheeled container, attached container on top of refuse container, and attached container on top of attached container, is similar to the present use for securing lids 9 to the Rubbermaid 32 gallon refuse container 10 and is described in detail in the Ferbrache U.S. Pat. No. 4,691,840 patent. In the secured position, the handle 4 is rotated about stud projection 18 in an upward and inward direction towards the center vertical axis of the wheeled recycle bin 1 until the tooth projection 16 is touching the indent 11. In the unsecured position the handle 4 is rotated about stud projection 18 in an outward and downward direction towards the center vertical axis of the wheeled recycle bin 1 until the handle rests on the container wall, or hangs freely.

The placement of the middle recycle bin 2A on the wheeled recycle bin 1 is different from refuse container lid 9 placement in that it may also be forced down while handles 4 are in the secured position. The sides of middle recycle bin 2A must also be aligned with the sides of the wheeled recycle bin 1 and the grips 21 of handles must be parallel to the axis of the wheels 8 when hitching. The middle recycle bin 2A is lowered so that it's lower portion nests inside the alignment edge 15 of the wheeled recycle bin 1 and the rest face 13 rests on the support face 14. The handles 4 that were initially in the secured position will have been displaced outwardly and then sprung back to the secured position by the elastic force of the stressed receptacle base recesses 19 on the lobe projections 17. Handles 4 that were initially in the unsecured position may now be moved to the secured position prior to tilting to form the rigid entity.

The placement of the upper recycle bin 2B on middle recycle bin 2A is similar to placement of the middle recycle bin 2A on wheeled recycle bin 1.

The placement of the upper recycle bin lid 5 on the upper recycle bin 2B is different from cylindrical refuse container lid 9 placement in that it the sides of the upper recycle bin lid 5 must also be aligned with the sides of the upper recycle bin 2B. The upper recycle bin lid 5 is lowered so that it's lower portion nests inside the alignment edge 15 of the upper recycle bin 2B and the lid rest face 13A rests on the support face 14. Handles 4 that were initially in the unsecured position may now be moved to the secured position.

The placement of the refuse container recycle bin 3 on the refuse container 10 is the same as refuse container lid 9 placement. Handles 4 that were initially in the unsecured position may now be moved to the secured position prior to tilting.

The hitching, also referred to as connecting, of refuse containers 10 and tiltable modular recycle containers, and multiple combinations there of, requires the same operation. The containers are easier to hitch when in the free standing vertical rest position but may also be hitched while one or both are tilted and when handles 4 are secured or not secured. The hitch 6 is placed preferably on the lower radius of the grip 21 so that the axial center of one of the clasps 37 is aligned with the axial center of the grip 21 and the outer clasp projection 38 and the inner clasp projection 35 rest on radius of the grip 21. The other clasp 37 is preferably located furthest from tooth projections 16. The clasp 37 and grip 21 are squeezed together, between fingers and palm, causing the flexible groove body 39 to straighten, increasing the distance between the inner clasp projection 35 and the outer clasp projection 38, until they pass the maximum outer diameter of the grip 21 after which clasp groove 39 will seat itself along the grip 21 as flexible groove body 39 returns to it natural unstressed shape. The clasp 37 is now free to rotate about the grip 21. The other unsecured clasp is similarly secured on the grip 21 of the container to be hitched. The unhitching of containers requires a force applied, preferably with the thumb, to release grip 32 in a direction tangential to the circumference of the grip 21 while supporting the handle 4 with fingers of hand or other hand. The tilting of independent containers is preferably achieved by placing one's foot in front of the base of the wheeled side of the container and pulling the container lid toward one's body with one hand holding the grip 21 of the handle 4 with the other hand. Hitched containers are tilted the same manner but preferably the rear container 10R is first tilted by placing one's foot in front of the wheeled side of it and pushing with foot while unsecuring handle 4 of the center container 10C adjacent to the wheels 8, and rolling the rear container 10R away from the center container 10C until the unsecured handle 4 is at handle tilted rest point 64. The center container 10C is tilted second, after tilting rear container 10R, in the same manner, and then the lead container 10L is tilted.

Conclusions, Ramifications and Scope

Accordingly, the reader will see that the tiltable modular recycle bin system of this invention fulfills a long felt need for a low cost container system to bring refuse and a number of recyclables to the curb in a single trip without carrying. The invention of forming a single rigid entity from adjoining independent units allows tilted transport while overcoming the lifting constraints and eliminating the cart. This coincides with new use for the Ferbrache style of handles as a means for securing containers to form a single rigid entity, single recycle bins on the top of refuse containers, and hitching tiltable containers at the top. This would also include such things as tiltable luggage or suit cases that are wheeled and general purpose utility carts for indoor and outdoor use.

Thus the scope of the invention should be determined by the appended claims and their legal equivalents, rather than by the examples given.

I claim:

1. A modular wheeled container system that is tilted from the free standing position for rolling consisting of open top containers that can nest within each other comprising:

a) a wheeled container having a means for rolling, a top interface, a means for securing across the said top interface b) a first attachable container which rests on top of said wheeled container, having a bottom and top interface and a means for securing across it's top interface c) an optional second attachable container having a bottom interface which rests on top of first said attachable container, to be added if the combined height of the said wheeled container and said first attachable container do not reach the height necessary for ergonomically comfortable tilting and rolling, d) a means for securing and lifting with two hands wherein said means for securing of said wheeled container secures between or across the adjoining interfaces of said top interface of said wheeled container to said bottom interface of said first attachable container wherein a two container single rigid entity is formed from the secured said wheeled container and said first attachable container wherein the said first attachable container becomes the vertical structural extension to allow ergonomically comfortable tilting and rolling of the said two container single rigid entity, and wherein a cart, frame, or vertically extending handle is no longer required, and wherein the tilting shifts the center of gravity of the load vertically above the axis of the said means for rolling and wherein the angle of tilt is greater than 10 degrees between the free standing position and tilted position, and whereby the vertical stability is increased without increasing either the effective lifting weight or adding horizontal protrusion to a wheeled container to widen the base to increase the vertical stability, and wherein the sum of the volumetric capacity of the said first attachable container and the said wheeled container is greater than 25 gallons and wherein the total volume of the said two container rigid entity is greater than 32 gallons, and wherein the said wheeled container can nest within the said first attachable container, and if said second attachable container is needed to reach the height necessary for ergonomically comfortable tilting and rolling wherein said means for securing of the first attachable container secures between or across the adjoining interfaces of said top interface of said first attachable container to said bottom interface of said second attachable container and wherein a three container single rigid entity is formed from the secured said wheeled container secured to said first attachable container, and said second attachable container secured to said first attachable container wherein said first attachable container and second attachable container become the vertical structural extension to allow ergonomically comfortable tilting and rolling of the said three container single rigid entity, and wherein a cart, frame, or vertically extending handle is no longer required, and wherein the tilting shifts the center of gravity of the load vertically above the axis of the said means for rolling and wherein the angle of tilt is greater than 10 degrees between the free standing position and tilted position, and whereby the vertical stability is increased without increasing the effective lifting weight or adding horizontal protrusion to a wheeled container to widen the base to increase the vertical stability, and wherein the sum of the volumetric capacity of the said first attachable container and the said wheeled container is greater than 25 gallons, and wherein the total volume of the said two container rigid entity is greater than 32 gallons, and wherein the said wheeled container can nest within the said first attachable container and said first attachable container can nest within the said second attachable container.

2. The system of claim 1 further including a means for hitching said two container single rigid entity or said three container single rigid entity to a second said two container single rigid entity or second said three container single rigid entity, for rolling in the tilted position wherein the said means for hitching fastens the said two container single rigid entity or said three container single rigid entity to a second said two container single rigid entity or second said three container single rigid entity, and wherein the tilting shifts the center of gravity of the load vertically above the axis of the said means for rolling and wherein the angle of tilt between the vertical axis of the said two container single rigid entity or said three container single rigid entity to a second said two container single rigid entity or second said three container single rigid entity is greater than 10 degrees between it's free standing position and tilted position and whereby the said two container single rigid entity or said three container single rigid entity fastened to a second said two container single rigid entity or second said three container single rigid entity is vertically stabilized in the tilted position and whereby castored wheels are no longer required.

3. The system of claim 2 wherein said two container single rigid entity or said three container single rigid entity and/or second said two container single rigid entity or said three container single rigid entity is a refuse container.

4. The system of claim 3 wherein first said attachable container is a recycle container on top of said refuse container.

5. The system of claim 4 wherein said means for securing said wheeled container or said refuse container to first said attachable container or first said attachable container to second said attachable container is a handle, telescope fit, groove, over center clasp, or latch.

6. The system of claim 2 wherein the said means for hitching remains fastened when moved from the tilted position to the free standing position.

7. The system of claim 2 wherein said rigid entity is a luggage device or general purpose cart.

8. The system of claim 3 wherein there is a plurality of hitched said two container single rigid entity or said three container single rigid entity or plurality of said refuse container or combination thereof.

9. The system of claim 5 wherein said refuse container includes;

a receptacle body having vertical side walls and a central cavity extending downwardly there between;

a lid having a downturned peripheral rim receivable over a top end of said receptacle body, said lid having peripherally located detent means;

at least two lid locking handle having an inward end pivotally coupled to said receptacle body side walls and an outward free end; said handle having camming handle locking projection means and lid locking projection means for respective engagement against said receptacle body side walls and said lid detent means as said handle free end is pivoted toward said receptacle body, and wherein a portion of said handle free end extends above a top surface of said lid, and wherein said handle locking projection means comprising at least one eccentric camming lobe disposed to rotate over said receptacle body side walls into a fixed, locked position, and wherein said receptacle body is formed of elastomeric plastics material deformable inwardly under influence of said camming lobe, and wherein said camming lobe residing in a vertically extending recess formed within said receptacle body, and wherein said lid locking projection means comprising a tooth extension projecting parallel and spaced apart from said camming lobe, and wherein said lid detent means being located in said lid peripheral rim, and wherein said lid detent means comprising a continuous groove in said lid peripheral rim adapted to receive said handle tooth extension therein, and wherein said lid and said receptacle body being of circular horizontal cross section whereby said lid is situatable upon said receptacle body throughout a 360 degree range of orientation, and wherein said lid locking handle having a generally U-shaped profile, comprising parallel arm segments extending from a central bight portion, with remote ends of said arm segments being pivotally coupled to said receptacle body, and wherein said handle locking projection means comprising at least one eccentric camming lobe disposed at a distal end of said handle and adapted to rotate over said receptacle body into a fixed locked position, and wherein said receptacle body being composed of resilient elastomeric plastics material deformable inwardly under influence of said camming lobe whereby said receptacle body exerting a residual outwardly directed frictional lock against said camming lobe in said fixed locked position, improvements comprising;

said attachable container is a recycle container to be secured on top of said refuse container instead of said lid wherein said recycle container which rests on the said refuse container including:

said recycle container having a downturned peripheral rim receivable over a top end of said receptacle body, said recycle container having peripherally located detent means;

at least two said lid locking handle, to be used to lock said recycle container instead of said lid, having an inward end pivotally coupled to said receptacle body side walls and an outward free end; said handle having camming handle locking projection means and recycle container locking projection means for respective engagement against said receptacle body side walls and said recycle container detent means as said handle free end is pivoted toward said receptacle body.

and wherein a portion of said handle free end extends above said recycle container detent means, and wherein said handle locking projection means comprising at least one eccentric camming lobe disposed to rotate over said receptacle body side walls into a fixed, locked position, improvements further comprising wherein said handle is said means for securing said recycle container to said refuse container whereby the volume of the container is increased without increasing the effective lifting weight and whereby the vertical extension of the said recycle container creates a second gripping position of significant distance above the said handle to allow a two handed vertical stabilizing force while rolling, improvements further comprising wherein said handle is said means for securing said first attachable container to said wheeled container, and second said attachable container to first said attachable container, and third said attachable container to second said attachable container, improvements further comprising wherein the said refuse container or said wheeled container has vertical height reduced for an equivalent 32 gallon volume wherein the vertical stability is increased and wherein the first said attachable container, and second said attachable container if needed, becomes the vertical structural extension to allow ergonomically comfortable tilting and rolling and wherein a cart, frame or vertically extending handle is no longer required, improvements further comprising wherein said handle of first said rigid entity and said handle of second said rigid entity and further said hitch are connected together to form said means for hitching whereby hitched said rigid entities or said refuse containers or combination thereof can be tilted for rolling, and remain hitched when tilted from free standing position and tilted for rolling position.

10. The said attachable container of claim 9 further including two or more said handle and said attachable container having a receptacle body having vertical side walls and a central cavity extending downwardly there between;

said attachable container having an outward peripheral rim receivable with top end of said receptacle body, said attachable container having peripherally located detent means;

at least two attachable container locking handle having an inward end pivotally coupled to said receptacle body side walls and an outward free end; said handle having camming handle locking projection means and attachable container locking projection means for respective engagement against said receptacle body side walls and said attachable container detent means as said handle free end is pivoted toward said receptacle body.

11. The said attachable container of claim 10 further including;

wherein said handle locking projection means comprising at least one eccentric camming lobe disposed to rotate over said receptacle body side walls into a fixed, locked position, and wherein said receptacle body is formed of elastomeric plastics material deformable inwardly under influence of said camming lobe, and wherein said attachable container locking projection means comprising a tooth extension projecting parallel and spaced apart from said camming lobe, and wherein said attachable container detent means being located in said attachable container peripheral rim, and wherein said attachable container detent means comprising a continuous groove in said attachable container peripheral rim adapted to receive said handle tooth extension therein, and wherein said attachable container locking handle having a generally U-shaped profile, comprising parallel arm segments extending from a central bight portion, with remote ends of said arm segments being pivotally coupled to said receptacle body, and wherein said handle locking projection means comprising at least one eccentric camming lobe disposed at a distal end of said handle and adapted to rotate over said receptacle body into a fixed locked position, and wherein said receptacle body being composed of resilient elastomeric plastics material deformable inwardly under influence of said camming lobe whereby said receptacle body exerting a residual outwardly directed frictional lock against said camming lobe in said fixed locked position.

* * * * *